United States Patent [19]

Du Buy

[11] Patent Number: 4,720,100

[45] Date of Patent: Jan. 19, 1988

[54] APPARATUS FOR EXERCISING THE ARM MUSCLES

[75] Inventor: Robert V. Du Buy, Amsterdam, Netherlands

[73] Assignee: Mandhy Products B.V., Cuijk, Netherlands

[21] Appl. No.: 810,871

[22] Filed: Dec. 17, 1985

[30] Foreign Application Priority Data

Dec. 18, 1984 [NL] Netherlands ..... 8403831

[51] Int. Cl.[4] ..... A63B 21/00

[52] U.S. Cl. ..... 272/134; 272/142; 272/140; 272/117; 272/130

[58] Field of Search ..... 272/DIG. 5, DIG. 6, 272/135–142, 134, 117, 130

[56] References Cited

U.S. PATENT DOCUMENTS

| | | | |
|---|---|---|---|
| 2,230,033 | 1/1941 | Hackett . | |
| 2,921,791 | 1/1960 | Berne . | |
| 3,132,861 | 5/1964 | Horney . | |
| 3,747,925 | 7/1973 | Seeger . | |
| 3,802,701 | 4/1974 | Good, Jr. . | |
| 3,912,261 | 10/1975 | Lambert, Sr. . | |
| 4,239,208 | 12/1980 | Walls . | |
| 4,244,021 | 1/1981 | Chiles | 272/DIG. 6 |
| 4,249,729 | 2/1981 | Gabrielidis . | |
| 4,329,210 | 12/1980 | Lambert, Jr. . | |
| 4,553,746 | 11/1985 | Lee | 272/DIG. 5 |

FOREIGN PATENT DOCUMENTS

| | | |
|---|---|---|
| 3039462 | 5/1982 | Fed. Rep. of Germany . |
| 369208 | 1/1907 | France . |
| 2045215 | 2/1971 | France . |
| 8005681 | 5/1982 | Netherlands . |

*Primary Examiner*—Richard J. Apley
*Assistant Examiner*—James Prizant
*Attorney, Agent, or Firm*—Majestic, Gallagher, Parsons & Siebert

[57] ABSTRACT

An apparatus for exercising the arm muscles of the human body, whereby the apparatus comprises a base with an inclined working surface mounted above it, whose height is adjustable and which is adjoined on both sides by means of sleeves by shafts, which shafts are so mounted on the base as to be rotatable about their long axis against resistance and which are provided at their top above the working surface with transversely attached hand grips by means of which the shafts can be loaded with a torque on their long axes.

13 Claims, 13 Drawing Figures

APPARATUS FOR EXERCISING THE ARM MUSCLES

Figure 1:
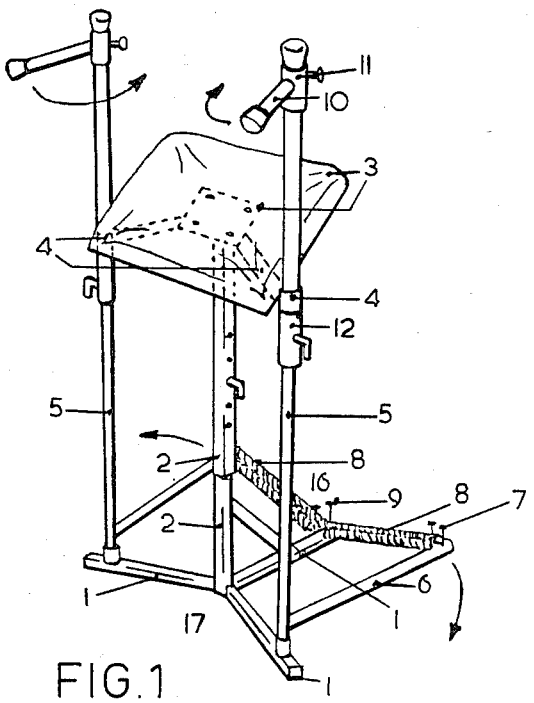

The invention relates to an apparatus for exercising the arm muscles of the human body.

There are numerous devices in existence for exercising the arm muscles such as parallel bars, vaulting-horses and bucks, punch balls, home trainers, dumb-bells, spring grip dumb-bells, as well as various spring expanders. Most of these appliances are intended for toning up one or more muscles.

The practising of six movements of the forearm muscles, such as supination (outward rotation of the thumb) and pronation (inward rotation of the thumb), whether or not in combination with biceps and triceps (the principal flexors and tensors of the arms), as well as radial adduction (the arms outstretched with the thumbs turned inward, whilst the hands are moved towards one another by means of movements of the wrist in the horizontal plane), ulnar adduction (the arms outstretched with the thumbs turned outward, whilst the hands are moved inward towards one another by means of movements of the wrist in the horizontal plane), radial abduction (the arms outstretched with the thumbs turned outward, whilst the hands are moved outward away from one another (="ab") by means of movements of the wrist in the horizontal plane) and ulnar abduction (the arms outstretched with the thumbs turned inward, whilst the hands are moved outward away from one another by means of movements of the wrist in the horizontal plane) is of great significance for heavy athletics, body-building, pole-vaulting, exercises on the vaulting-horse and the rings, walking on the hands, rowing, canoeing and gymnastics, whilst the said exercises of movements of the forearm muscles can also be used for rehabilitation.

No suitable apparatus are available for the specific practising of supination and pronation movements in which overstraining is precluded. Supination and pronation movements of the forearm afford training of the following muscles:

- Musculus flexor carpi radialis, general hand flexor, providing support in pronation;
- Musculus brachioradialis, muscle of the radius, permitting pronation and supination depending on its position;
- Musculus pronator teres, muscle producing pronation;
- Musculus brachialis, internal arm muscle for tightening the capsula of the elbow joint;
- Musculus biceps brachii, two-headed arm muscle, supinating the forearm.

To tone up the forearms as regards their twisting function (for instance, in tightening or slackening of a screw), whereby the supination and the pronation movement of the forearm is practised, exercises with dumb-bells are possible. They require the user to stand upright and hold a dumb-bell in each hand, whilst the arms hang slightly away from the body.

Now when the dumb-bells are caused to rotate on their mass centre about the axis of the arms, which are held outstretched, the supination and the pronation movement can be practised. This involves turning the radius round the ulna backward and forward.

A disadvantage of these exercises with the dumb-bells is the so-called overshooting (flywheel effect) due to the muscles not being developed equally strongly, so that one muscle is already overstrained when another muscle is not yet near the limit of its capacity.

The capsula has to bear the brunt of the braking action, which may result in injuries to the articulus cubiti (elbow joint) and dislocation of the ulnar and/or radial collateral ligaments. One consequence may be a considerable damage to the capsula of the elbow joint.

Bar-swinging exercises have been devised for the separate practising of radial adduction, ulnar adduction, radial abduction and ulnar abduction. These exercises also involve certain risks, however, because the mass of the bar is prone to overshooting.

It is an object of the present invention to provide an apparatus of the type mentioned in the opening paragraph with which the aforesaid six movements of the forearm muscles can be practised on both arms at once or on either arm in turn. To this end, such an apparatus has been designed so that it comprises a base with an inclined working surface mounted above it, whose height is adjustable and which is adjoined on both sides by means of sleeves by shafts, which shafts are so mounted on the base as to rotatable about their long axis against resistance and which are provided at their top above the working surface with transversely attached hand grips by means of which the shafts can be loaded with a torque on their long axes.

The apparatus has the advantage that it now becomes possible to step up the muscular tension in a muscle or a set of muscles slowly and continuously and subsequently reduce it again, which makes for safer and far more pleasant practising than the inconvenient movements involved in dumb-bell turning and bar swinging.

A further elaboration of the invention provides for a transverse arm fitted to the rotatable attachment of each vertical shaft to the base, the end of which arm carries a spiral spring disposed crosswise to the shaft.

An additional feature is possible in that the rotatable means of attachment of each vertical shaft to the base may comprise a torsion spring mounted round the shaft or in line with it.

This has the advantage that the muscular tensions can be stepped up in small increments to be adjusted by the user through increases in spring tension, whereby flywheel effects are precluded.

Furthermore, the said advantage can also be gained if the resistance of the rotatable attachment of the vertical shafts to the base is effected by means of compressed-air or hydraulic springs, provision being made for limitation with the aid of an adjustable valve.

It is to be observed that from U.S. Pat. No. 3 428 311 a rod which can be rotated with the aid of a handle is known. At one end the rod has the said handle and at the other end it is provided with a ball which can rotate with a friction that may be adjusted very approximately in a seat mounted on the base.

This apparatus has the drawback that only supination and pronation movements can be practised, with a friction between ball and seat that is less simply adjustable to the user. The measurement of the torque exercised on the bar is erratic with this apparatus, so that individual adjustment of the device is also hardly practicable. In addition, it offers no possibility of combining muscular movements, with particular reference to a combination of biceps and triceps with pronation or supination.

Figure 2:
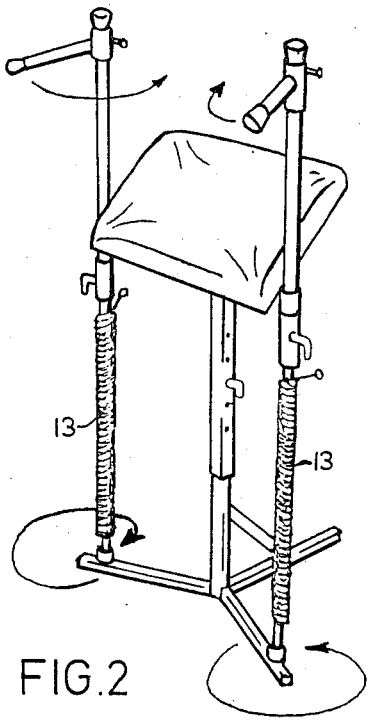
Figure 3:
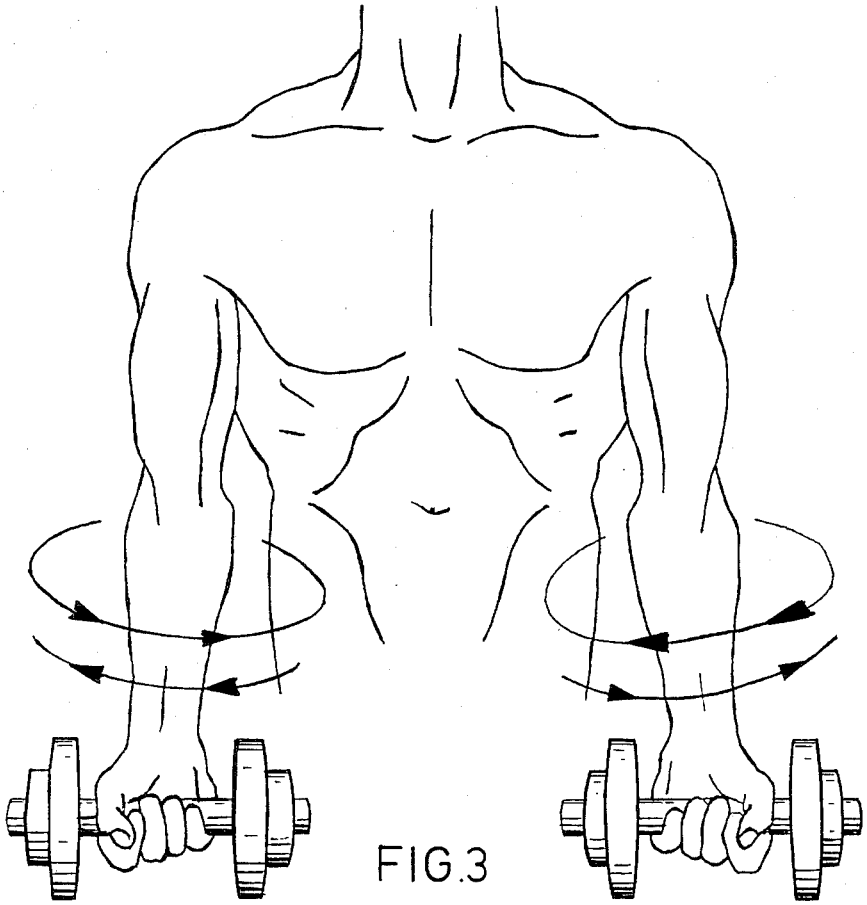
Figure 4:
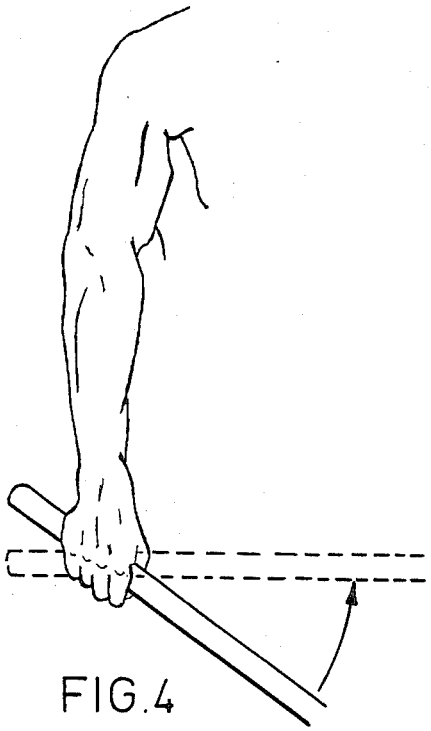
Figure 5:
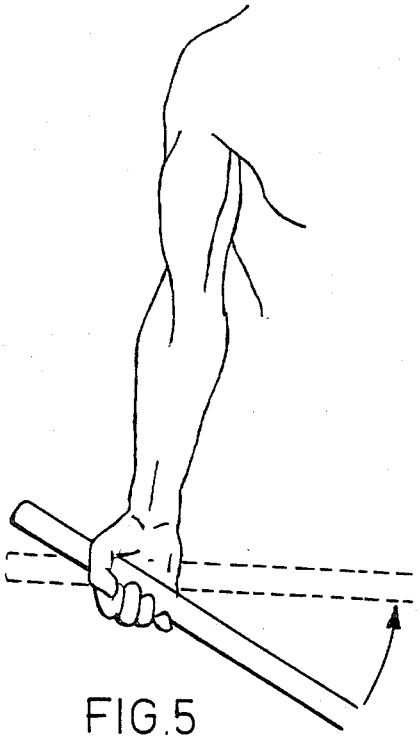
Figure 6:
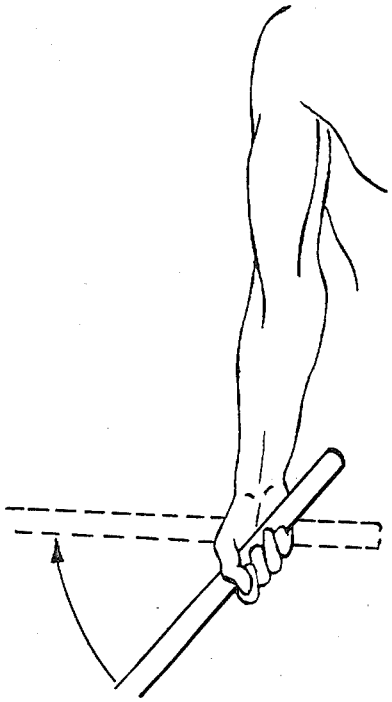
Figure 7:
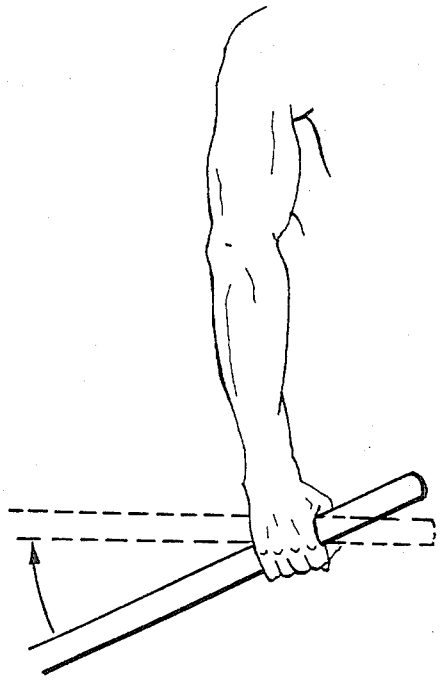
Figure 10:
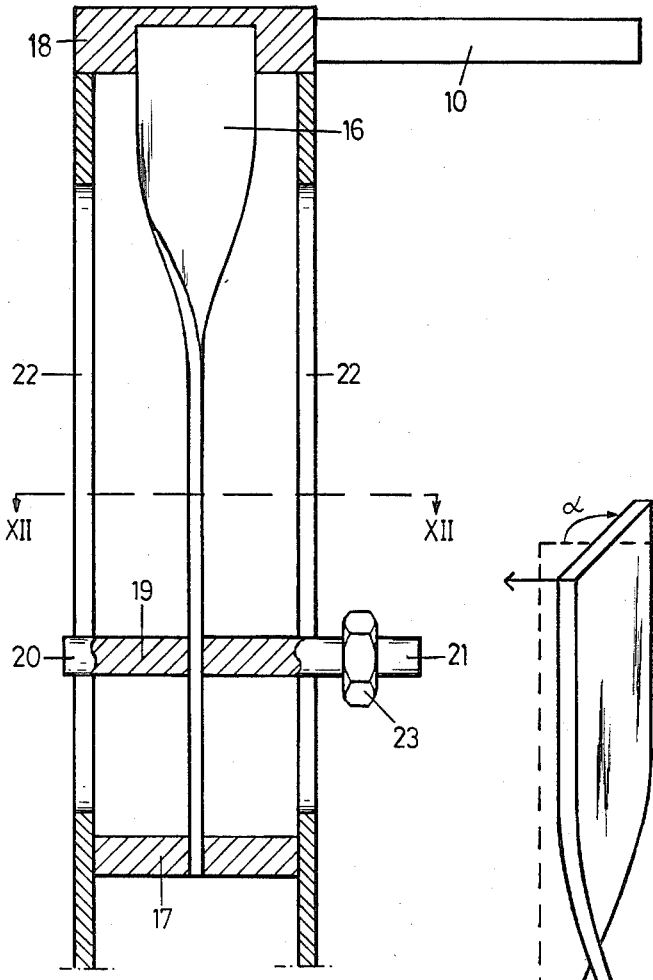
Figure 8:
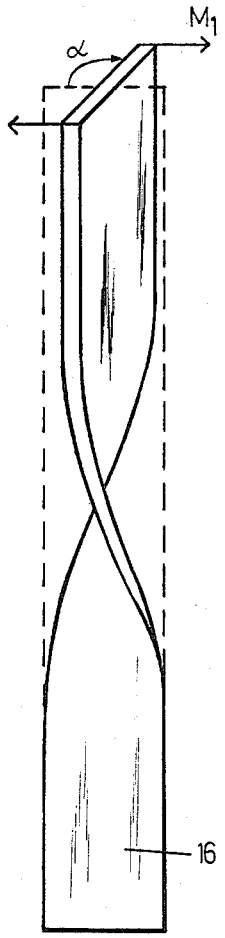
Figure 9:
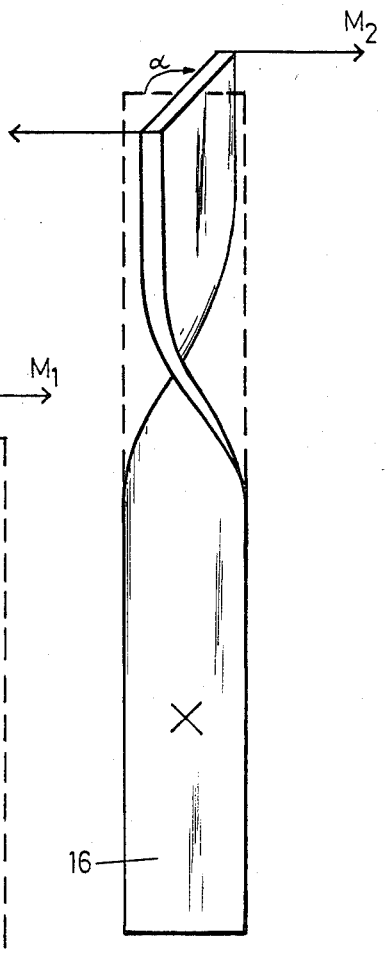
Figure 11:
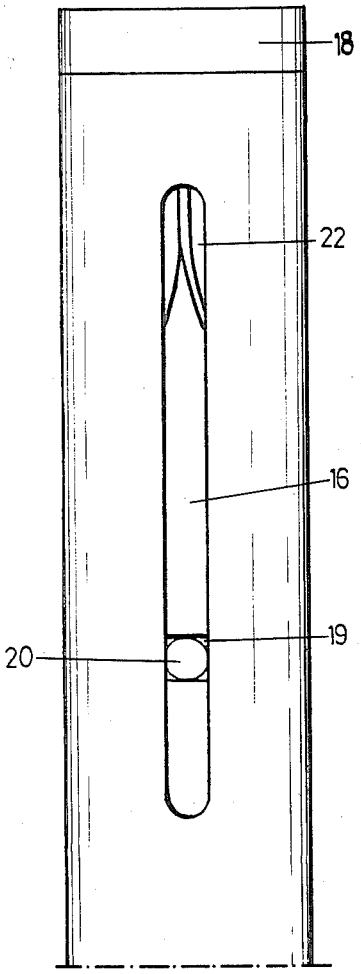
Figure 12:
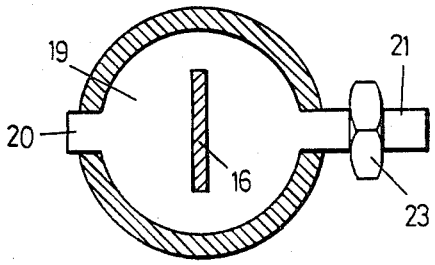
Figure 13:
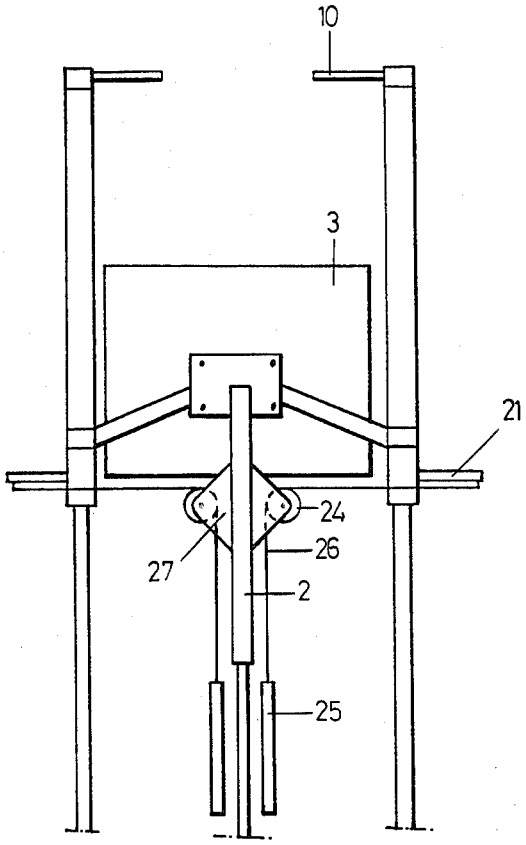

For a further elucidation of the invention, two embodiments will now be described by way of example with reference to the drawings, which show the following:

FIG. 1 in oblique projection, the apparatus according to the invention equipped with spiral springs;

FIG. 2 is oblique projection, the apparatus according to the invention equipped with torsion springs;

FIG. 3 the supination and the pronation movement of the forearm practised in traditional fashion with dumb-bells;

FIG. 4 the radial adduction movement of the forearm practised in traditional fashion with a swing bar;

FIG. 5 the ulnar adduction movement of the forearm practised in traditional fashion with a swing bar;

FIG. 6 the radial abduction movement of the forearm practised in traditional fashion with a swing bar;

FIG. 7 the ulnar abduction movement of the forearm practised in traditional fashion with a swing bar;

FIG. 8 a torsion spring twisted over its entire length;

FIG. 9 a torsion spring twisted over part of its length;

FIG. 10 a cross-sectional view of a post design incorporating a torsion spring;

FIG. 11 the post of FIG. 10 viewed from the left-hand side;

FIG. 12 a cross-sectional view of the post of FIG. 10 taken along the line XII—XII; and FIG. 13 a rear view of the apparatus according to another embodiment of the invention.

As is indicated in FIG. 1, the apparatus consists of a base 1, which may have been assembled from three round or square tubes with a diameter of about 20 mm and a length varying between 30 and 50 cm. Mounted perpendicular to the base there are the vertical shafts 5 and telescoping post 2 for the support of the working surface 3, on which the elbows can be rested.

In the figures the adjustments of the height of the working surface 3 and the hand grips 10 is realized by means of a discrete pin-and-hole connection between the enveloping and the enveloped sections of post 2. As the holes in the enveloping section of post 2 have been bored at fixed distances from one another, discrete working levels can be set. Alternatively, however, the enveloped section of post 2 may be provided with a radially tapering keyway, the key seat being deepest at the top of the enveloped section of post 2 and terminating virtually level with the outer diameter of the enveloped post at its base. By further tightening of a bolt in the enveloping section of post 2 the working level will be set higher. In this preferred design it is possible to achieve infinite adjustment of the working level.

Below the working surface 3 the supports 4 have been provided with the associated sleeves 12, which have been fitted round the vertical shafts 5. At the upper end of the vertical shafts the hand grips 10 have been attached, which are fastened with the bolts 11. At the lower end of the vertical shafts, transverse arms 6 have been mounted whose length may vary between 30 and 60 cm and whose diameter is about 25 mm, with spiral springs 8 attached to the ends of the arms by means of pins 7 so as to be crosswise to the vertical shafts 5. The spiral-spring configuration can be adapted to the capacities of the user.

Seated behind point 16, the user of the apparatus practises the following movements of the forearm muscles by gripping the handles 10 with the palms of his or her hands:

supination + flexion of biceps pronation + extension of triceps (only with this movement should the action of the spring be reversed).

Standing behind point 16, the user of the apparatus practises the following movements of the forearm muscles by gripping the handles 10 with his or her palms turned either up or down:

ulnar adduction + biceps + triceps radial adduction + biceps.

Standing in front of point 17, the user of the apparatus practises the following movements of the forearm muscles by gripping the handles 10 with his or her palms turned either up or down:

ulnar abduction + triceps radial abduction + triceps + biceps.

In FIG. 2 the rotation of shafts 5 against resistance is further refined by the installation of torsion springs 13. It stands to reason that the torsion-spring configuration can be adapted to the user's capacities.

FIG. 3 schematically represents the supination movements according to 14 and the pronation movements according to 15, when practised by the rotation of dumb-bells in traditional fashion.

The movements of the forearm muscles performed with the aid of a traditional swing bar are represented in FIG. 4 for radial adduction, in FIG. 5 for ulnar adduction, in FIG. 6 for radial abduction and in FIG. 7 for ulnar abduction.

Instead of the helical torsion springs 13 represented, flat torsion springs 16 are preferably employed in actual practice. The spring characteristic of these can be set without replacement of the springs, as required in the case of the helical torsion springs 13, by limiting the effective blade length available for twisting.

FIGS. 8 and 9 illustrate how the spring characteristic can be set by variation of the blade length available for twisting. A blade gripped at both ends will require a torque $M_1$ for ratation through an angle $\alpha$. If, however, the lower gripping point is shifted higher up the blade, a smaller blade length remains available for twisting. The torque $M_2$ required to effect rotation through the same angle $\alpha$ will now be greater than $M_1$.

Variable gripping of a blade accommodated in a post can be achieved by means of a groove made in the longitudinal direction of the post. In the non-tightened position, a bolt can freely move up and down the groove and after having been tightened, it grips the blade at the height set.

In the preferred embodiment, as represented in FIGS. 10, 11 and 12, the torsion spring 16 mounted in a post is gripped at its lower end by a clamping plate 17 and at its upper end by rotating disc 18 to which the handle 10 has been attached. Now the adjustment of the tension of torsion spring 16 is effected by means of a vertically adjustable clamping disc 19 which is guided through two round notches 20 and 21 up and down slits 22 in the post. By providing a notch 21 with a screw thread it is possible to fasten the clamping disc 19 at a certain height with the aid of nut 23. The notches 20 and 21 prevent the clamping disc 19 from turning round with the torsion spring 16, whilst the thickness of the clamping disc 19 and the fine fit of the blade 16 in the clamping disc 19 preclude an oscillating tilt.

Besides the constructions with springs described hereinbefore, it is also possible to derive an opposing force from a post configuration comprising a cable or chain 20 which is connected to a transverse arm 21 mounted on the rotatable means of attachment of the shaft, a pulley or sprocket wheel 24 and a pendent weight 25.

FIG. 13 depicts an embodiment in which the hand grips 10 have been turned wholly inward and the transverse arms 21 wholly outward. The weights 25 are virtually in their uppermost position. The cables or chains 26 are passed over pulleys or sprocket wheels 24, respectively, which have been fitted underneath the working surface 3 by means of ears 27 on the telescoping post 2.

If desired, the pulley or sprocket wheel 24 may deviate from a circular shape and be designed, for instance, to be elliptical.

As it is desirable to know the amount of muscular energy expended especially in heavy athletics, the apparatus according to the invention may be provided with measuring devices known in the art.

I claim:

1. An apparatus for exercising the arm muscles of the human body, characterized in that the apparatus comprises a base with an inclined working surface positioned above said base, said inclined working surface being mounted on said base by means of a plurality of sleeves mounted on said working surface and a plurality of shafts, said shafts being rotatably mounted in said sleeves and said sleeves being vertically movable so that the height of said working surface is adjustable with respect to said base, pivot means on said base mounting said shafts on said base so as to be rotatable about their longitudinal axis, resistance means on said apparatus for providing resistance against rotation, hand grips transversely attached to the ends of said shafts opposite their pivot ends for manually imparting rotational movement to said shafts against the resistance provided by said resistance means.

2. An apparatus according to claim 1, characterised in that the resistance means comprises a transverse arm of which the end carries a spiral spring disposed transverse to the shaft.

3. An apparatus according to claim 1, characterized in that said resistance means comprises a torsion spring mounted around the shaft or in line with it.

4. An apparatus according to claim 1, characterized in that said shafts which are rotatable about their longitudinal axes are substantially vertical.

5. An apparatus according to claim 1, characterized in that said resistance means comprises compressed-air springs, and an adjustable valve for limitation of said compressed-air springs.

6. An apparatus according to claim 1, characterized in that said resistance means comprises hydraulic springs, and an adjustable valve for limitation of said hydraulic springs.

7. An apparatus according to claim 3, characterized in that the torsion spring consists of a torsion blade mounted within a post, whose tension can be variably adjusted.

8. An apparatus according to claim 7, characterized in that the post further includes at least one slit in the longitudinal direction in order to guide a clamping member for variable adjustment of the spring tension.

9. An apparatus according to claim 8, characterized in that the clamping member consists of a clamping disc provided with two round notches which have been disposed in two slits, while the disc is so designed as to afford a close fit for the torsion blade.

10. An apparatus according to claim 1, characterized in that said resistance means comprises a transverse arm mounted above the base, at the end of which arm a cable is connected transverse to the shaft, which cable is passed over a pulley and provided at its end with a weight.

11. An apparatus according to claim 1, characterized in that said resistance means comprises a transverse arm mounted above the base, at the end of which arm a chain is connected transverse to the shaft, which chain is passed over a sprocket wheel and provided at its end with a weight.

12. An apparatus according to claim 10, characterized in that the pulley has an elliptical circumference.

13. An apparatus according to claim 11, characterized in that the sprocket wheel has an elliptical circumference.

* * * * *